US006817885B2

(12) United States Patent
Josquin et al.

(10) Patent No.: US 6,817,885 B2
(45) Date of Patent: Nov. 16, 2004

(54) ARRANGEMENT FOR THE ELECTRICAL CONNECTION OF A LAMP

(75) Inventors: Daniel Josquin, Bobigny Cedex (FR); Alexandre Mensales, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 10/232,986

(22) Filed: Aug. 28, 2002

(65) Prior Publication Data

US 2003/0045151 A1 Mar. 6, 2003

(30) Foreign Application Priority Data

Aug. 31, 2001 (FR) ..... 01 11504

(51) Int. Cl.[7] ..... H01R 13/64
(52) U.S. Cl. ..... 439/374
(58) Field of Search ..... 439/310, 332, 439/374, 375, 376, 546, 617, 918

(56) References Cited

U.S. PATENT DOCUMENTS 4,100,448 A * 7/1978 Chipner et al. ..... 313/318.11
4,513,356 A * 4/1985 Mikola ..... 362/226
4,573,754 A 3/1986 Hill ..... 339/60
4,630,877 A * 12/1986 Moore ..... 439/282
4,631,651 A * 12/1986 Bergin et al. ..... 362/267
4,804,343 A * 2/1989 Reedy ..... 439/854
5,035,643 A * 7/1991 Forish et al. ..... 439/358
5,637,020 A * 6/1997 Ito ..... 439/699.2

FOREIGN PATENT DOCUMENTS

EP 0 893 647 1/1999

OTHER PUBLICATIONS

French Search Report, May 2, 2002.

* cited by examiner

*Primary Examiner*—Thanh-Tam Le
(74) *Attorney, Agent, or Firm*—Morgan & Finnegan, LLP

(57) ABSTRACT

The invention proposes an arrangement for the electrical connection of a lamp of the type that is fitted in a support and connected electrically to an electrical power-supply harness by having fixed terminals in contact with connecting terminals carried by a terminal block. The fixed terminals extend laterally outward from the base of the lamp along directions contained in a substantially transverse plane. The terminal block is movably fitted with respect to a support between a locked position in which, the connecting terminals are in electrical contact with the fixed terminals, and an unlocked position in which, the connecting terminals are spaced from the fixed terminals.

19 Claims, 8 Drawing Sheets

Fig. 4
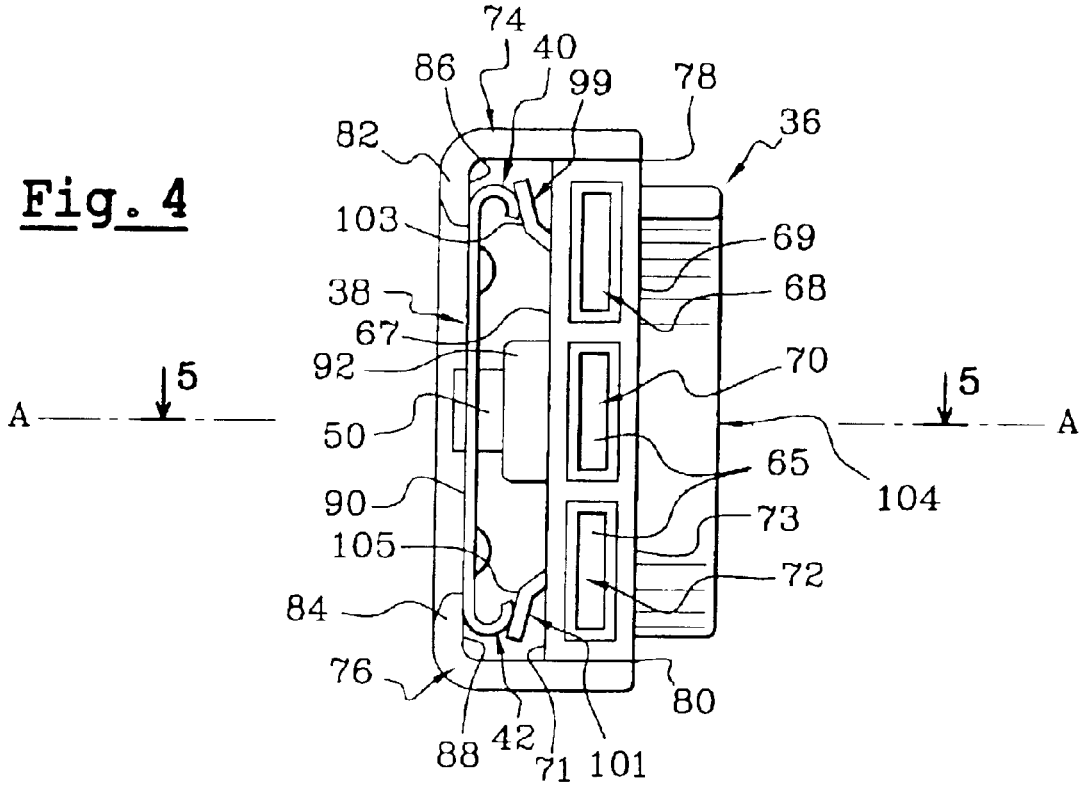
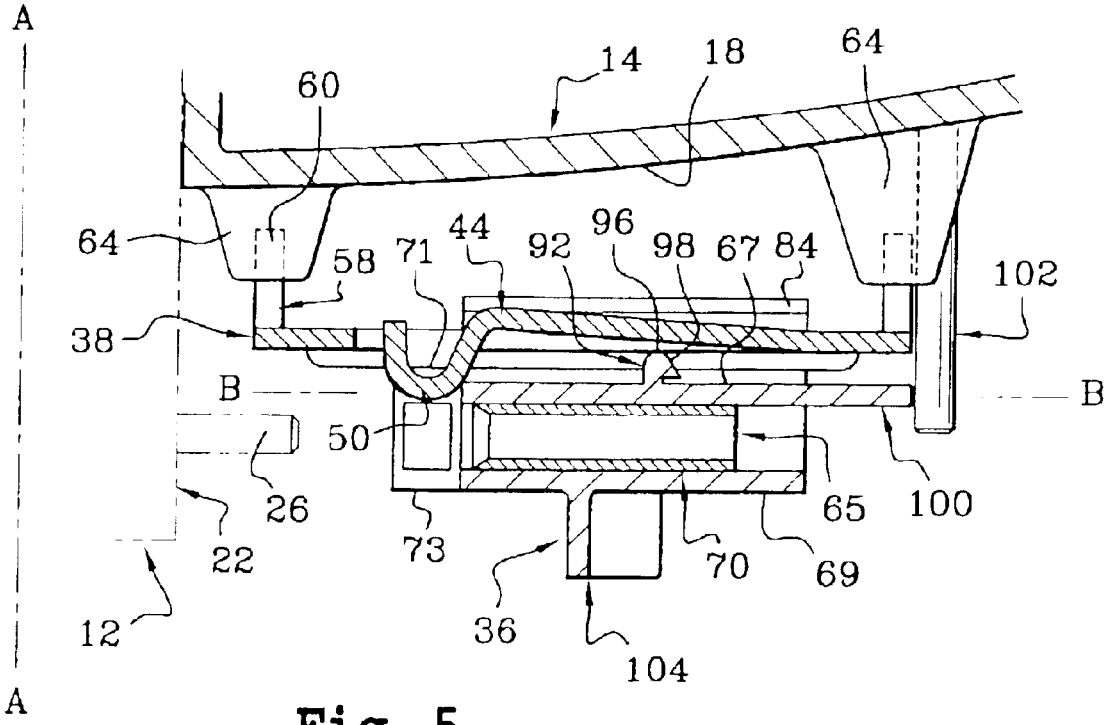
Fig. 5

ARRANGEMENT FOR THE ELECTRICAL CONNECTION OF A LAMP

FIELD OF THE INVENTION

The present invention relates to an arrangement for the electrical connection of a lamp.

BACKGROUND OF THE INVENTION

The present invention relates more particularly to an arrangement for the electrical connection of a lamp, especially in a motor-vehicle headlamp, of the type in which the lamp includes a light-source element, axially at the front, and, at the rear, a lamp base equipped with fixed connecting terminals, of the type in which the lamp is fitted in a support by way of a hole and it is connected electrically to an electrical power-supply harness by having the fixed terminals put in contact with associated connecting terminals carried by a terminal block.

In general, the elements for fitting and connecting a motor-vehicle headlamp are arranged in the following way.

Electrical wires originating from the power-supply harness of the vehicle arrive in proximity to the rear face of the headlamp and are connected to the connecting sockets of a lamp holder.

The lamp includes contact strips oriented axially towards the rear.

The contact strips are inserted axially into the sockets associated with the lamp holder, then the lamp holder is fitted into a complementary receptacle arranged at the rear of the headlamp.

One of the main reasons explaining the difficulties encountered in forming the electrical connection in this type of arrangement is that the connecting manoeuvre has to be carried out "blind".

This is because the accessibility to the lamps which equip the headlamps is often poor, which makes it difficult to change these lamps, in particular the manual operations aimed at inserting or removing the lamp, and the manual operations aimed at carrying out the electrical connection, or the disconnection respectively, of the lamp.

Moreover, these operations have to be able to be carried out by the driver of the motor vehicle. Consequently, handling operations have to be simple and prevent errors in fitting and/or in connection, while ensuring the safety of the driver and the reliable operation of the lamp.

During the manufacture of the connecting elements of the headlamp, a significant length of the electrical wires is generally provided so as to facilitate handling of the lamp holder and of the lamp upon connection.

Consequently, when the lamp holder is fitted into its receptacle, it transpires that the electrical wires are poorly positioned within the headlamp. They may, for example, be trapped in the elements for fixing the lamp onto its support or be jammed between the lamp and the reflector of the headlamp. These situations may be sources of malfunctioning of the headlamp.

In order to solve these problems, it is known, for example, to use a lamp holder with internal connections such as those which are described in the documents DE-A-298.23.160 and EP-A-0.898.114.

This type of arrangement is used especially in direction-change indicator lamps and in headlamps with an adjustable reflector.

In this type of arrangement, electrical wires for connecting to the power-supply harness of the vehicle are arranged in the framework of the headlamp and are connected to connecting terminals arranged in a receptacle carried by the rear face of the reflector.

The axial contact strips of the lamp are inserted into the corresponding sockets of a suitable lamp holder which includes connecting terminals complementary to those carried by the receptacle.

The lamp holder equipped with the lamp is fitted into the receptacle by a forwards axial movement, then a movement of pivoting of the lamp about its axis until the terminals of the lamp holder come into electrical contact with the associated terminals of the receptacle and form the connection.

These devices are not completely satisfactory. This is because problems of reliability may become apparent in use, which are due especially to their complex structure.

The operations necessary for the connection of a lamp according to this arrangement exhibit risks of errors which can lead to an incorrect connection of the lamp or to the deterioration of the elements constituting the arrangement.

Moreover, the substantial cost of these devices is a penalty.

The invention aims to remedy these drawbacks by proposing an economical arrangement which makes it possible to form the electrical connection of a lamp via simple handling operations.

SUMMARY OF THE INVENTION

To that end, the invention proposes an arrangement of the type described above, characterised in that the fixed terminals extend laterally overall from a portion of the axial surface of the lamp base outwards along directions which are each contained in a substantially transverse plane, and in that the terminal block is fitted movable with respect to the support between a locked position in which the connecting terminals are in electrical contact with the associated fixed terminals, and an unlocked position in which the connecting terminals are spaced away from the fixed terminals, in such a way that the movement of the terminal block to its locked position, or to its unlocked position, causes the connection, or the disconnection respectively, of the lamp with the electrical power-supply harness.

In a preferred way, the support consists of the reflector of the headlamp (the terminal block then being fitted movable with respect to the rear wall of the said reflector). However, this support can also be a piece other than the reflector, especially an additional piece advantageously fixed by any mechanical means to the rear wall of the reflector.

According to other characteristics:

the terminal block is fitted movable, with respect to the support, in a substantially transverse connecting plane;

the fixed terminals are substantially parallel to the transverse connecting direction, and the terminal block is fitted so as to slide along the transverse connecting direction;

the terminal block is fitted sliding on a slideway which is affixed to the support of the lamp;

the terminal block is fitted so as to pivot about an axis substantially parallel to the axis of the lamp;

the terminal block includes an arm which extends generally in the transverse connecting plane and which is fitted so as to pivot about its axis by one of its free extremities, so that the connection, or the disconnection, of the lamp takes place via pivoting of the terminal block towards the lamp, or spacing away from the lamp, respectively;

the axis of pivoting of the terminal block is substantially coaxial with the axis of the lamp;

the terminal block, in its axial face opposite the lamp, includes an axial clearance aperture which is associated with each fixed terminal of the lamp and which is offset in angle with respect to the corresponding connecting terminal in such a way that, in the unlocked position, each clearance aperture is substantially aligned radially with the associated fixed terminal, so as to allow withdrawal of the lamp axially rearwards;

the terminal block pivots about the axis of the lamp, sliding along a circumferential direction, and the terminal block includes at least one guide slot of overall circumferential orientation which interacts with at least two axial guide studs fixed into the support and passing through the associated slot, with a view to guiding the terminal block in sliding along the circumferential direction;

the terminal block is fitted pivoting about a substantially transverse axis and, in the locked position, each connecting terminal is in contact with a rear face of the associated fixed terminal, in such a way that, in order to pass from its locked position to its unlocked position, the terminal block pivots rearwards, and, in order to pass from its unlocked position to its locked position, the terminal block pivots forwards;

the fixed terminals are oriented along directions which are each substantially radial with respect to the axis of the lamp;

the lamp is fitted so as to pivot about its axis in the corresponding hole of the support, and the terminal block is designed to be placed in locked position after the fitting of the lamp in such a way that, in its locked position, it immobilises the lamp in its fitted position, and/or in such a way that, if it occupies its locked position before the fitting of the lamp, it then renders this fitting impossible;

the arrangement includes means for indexing the terminal block in its unlocked position;

the arrangement includes at least one abutment element which limits the displacement of the terminal block in the direction of its locking and/or of its unlocking;

the fixed terminals are contact strips substantially parallel to the transverse plane;

the terminal block includes a gripping element which makes it possible for a user to shift the terminal block from its locked position into its unlocked position, and conversely.

BRIEF DESCRIPTION OF THE DRAWINGS

Other characteristics and advantages of the invention will become apparent upon reading the detailed description which follows for an understanding of which reference will be made to the attached drawings, among which:

FIG. 4 is a side view along the arrow F4 of FIG. 2 which diagrammatically represents the terminal block when it is fitted on the slideway;

FIG. 5 is a view in axial section, along the sectional plane 5—5 of FIG. 4, which diagrammatically represents the terminal block in unlocked position;

DESCRIPTION OF THE PREFERRED EMBODIMENTS

In the description which will follow, elements which are substantially identical or similar will be designated by identical references.

Figure 1:
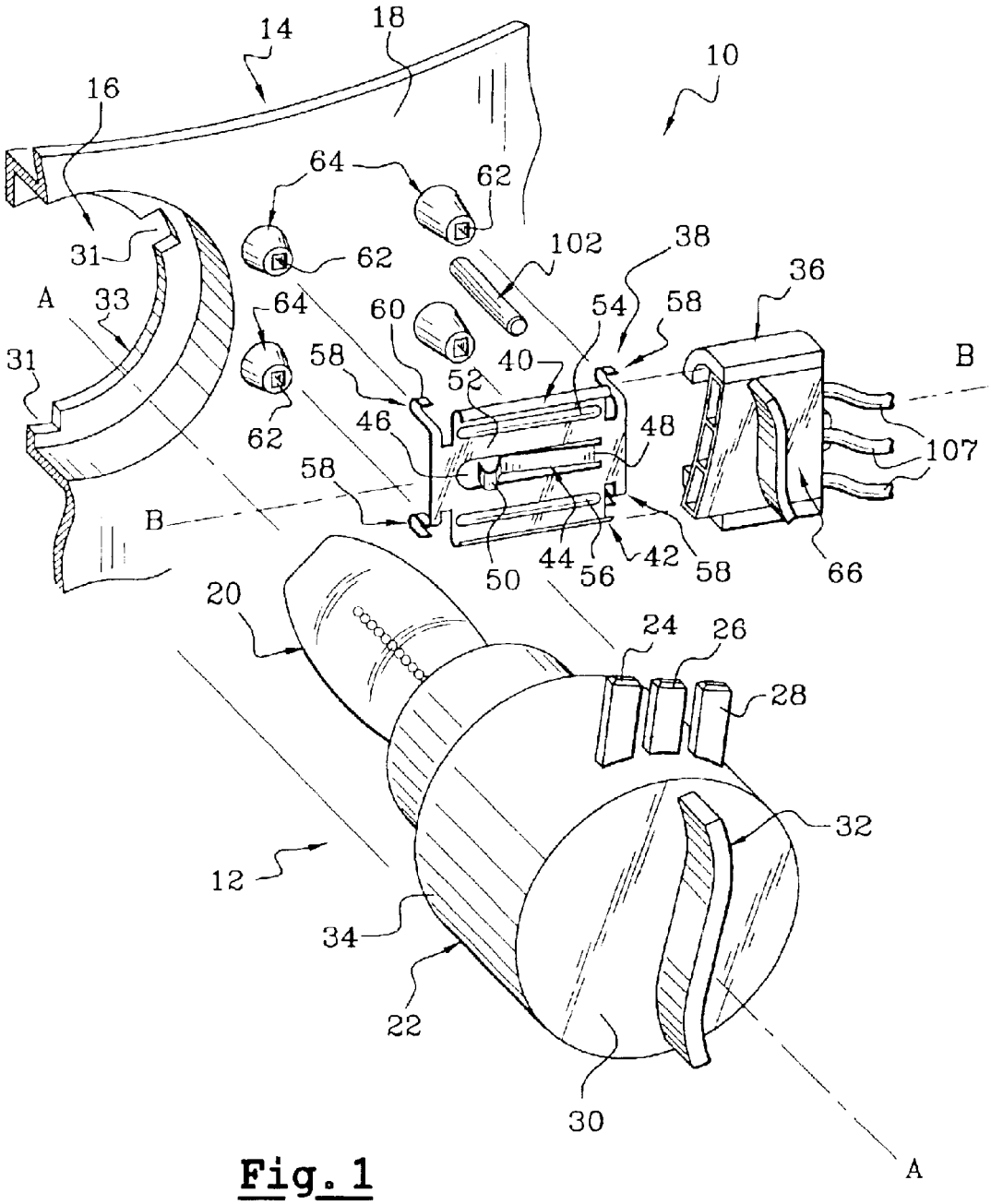
FIG. 1 is an exploded view in perspective which diagrammatically represents an arrangement in accordance with the teachings of the invention according to a first embodiment.

An arrangement 10 has been represented in FIG. 1, this arrangement being produced in accordance with the teachings of the invention, for the electrical connection of a lamp 12 in a motor-vehicle headlamp.

The headlamp has not been represented in its entirety, but a portion of a reflector 14 has been represented, which includes a hole 16 for the fitting of the lamp 12.

The reflector 14 is seen here from its non-reflecting rear-face side 18.

The lamp 12 is oriented generally along an axis A—A, which here represents the fitting axis and which can be coincident with the optical axis of the reflector 14.

In the remainder of the description, in a non-limiting way, a front-to-rear orientation along the axis A—A will be used, which corresponds overall to an orientation from top to bottom in FIG. 1.

A configuration element 10 will be described as transverse when it belongs generally to a plane transverse to the axis A—A.

The lamp 12, at the front, includes a bulb 20 which contains a filament (not represented), for example, forming the light source of the headlamp and, at the rear, includes a lamp base 22 carrying fixed connecting terminals 24, 26, 28.

The lamp base 22 here has a generally cylindrical shape with axis A—A. It advantageously includes, on its rear transverse face 30, a gripping element 32 which here has the shape of a wavy claw extending axially rearwards and which allows a user to handle the lamp 12 easily so as to make it pivot about its axis A—A.

The lamp base 22 conventionally includes fitting and indexing means (not represented), such as spigots, which are designed to interact, for example, with notches 31 produced in the inner edge 33 of the fitting hole 16.

The lamp base 22 is designed here to be fitted into the hole 16 by way of a bayonet system.

In the embodiment represented here, the fixed connecting terminals consist of three contact strips 24, 26, 28 which belong generally to the same transverse plane and which extend substantially parallel to an outwards, transverse, connecting direction B—B, that is to say, going away from the lamp 12, generally laterally from the axial surface 34 of the lamp base 22.

The transverse direction B—B here is a direction orthogonal to the axis A—A and substantially horizontal.

Needless to say, this transverse direction B—B could be oriented differently without departing from the scope of the invention.

In a non-limiting way, an orientation from left to right will be used, along the transverse direction B—B which corresponds overall to the orientation of FIG. 1.

In accordance with the teachings of the invention, the arrangement 10 also includes a terminal block 36 which is fitted so as to slide on a slideway 38 along the transverse direction B—B.

The slideway 38 here is an attached piece, but it could also form part of the reflector 14 or of another element of the headlamp, being produced, for example, by moulding.

The slideway 38 here has the shape of a substantially rectangular transverse plate.

Advantageously, the slideway 38 is a sheet-metal piece produced, for example, by cutting-out, stamping and folding.

When considering FIG. 1, it is observed that the upper transverse edge 40 and the lower transverse edge 42 of the slideway 38 are curved over rearwards and towards the slideway 38, so as to form an upper guide rail 40 and a lower guide rail 42 respectively.

As can be seen especially in the side view of FIG. 4, each rail 40, 42 has a generally "C"-shaped profile.

The slideway 38 advantageously includes an elastic tab 44 which is arranged here in a central portion of the slideway 38 delimiting a substantially oblong window 46 which extends in a transverse direction.

The tab 44 extends inside the window 46 from an extreme right-hand transverse edge 48 which delimits a substantially vertical fold, when considering FIG. 1. The tab 44 is therefore capable of pivoting by elastic deformation about the edge 48, forwards and rearwards, from its rest position which is represented in FIG. 1.

The left-hand transverse extremity of the tab 44 is folded back into a hook shape so as to form a boss 50 projecting substantially axially rearwards, with respect to the rear face 52 of the slideway 38, when the tab 44 occupies its rest position.

The slideway 38 here includes two ribs 54, 56 which extend substantially transversely (B—B) on its rear face 52, respectively above and below the window 46.

These ribs 54, 56 serve especially to stiffen the slideway 38 along the transverse direction B—B, especially so as to ensure reliable sliding of the terminal block 36 on the slideway 38.

Each of the claws 58 here extends substantially axially forwards, and it has its front axial extremity 60 curved over into a rearwards hook shape, so as to allow the fitting of the slideway 38 on the rear face 18 of the reflector 14 by penetration and jamming of each claw 58 into a complementary hole 62.

In the embodiment represented here, the holes 62 associated with the claws 58 are produced in studs 64 carried by the rear face 18 of the reflector 14.

The studs 64 are preferably produced by moulding with the reflector 14.

The slideway 38 is represented in fitted position on FIGS. 2 to 9.

The terminal block 36 will now be described by reference to FIGS. 3, 4, 5 and 8, in which it is represented when it occupies its fitted and unlocked position on the slideway 38, the lamp 12 also occupying its fitted position in the reflector 14.

Figure 6:
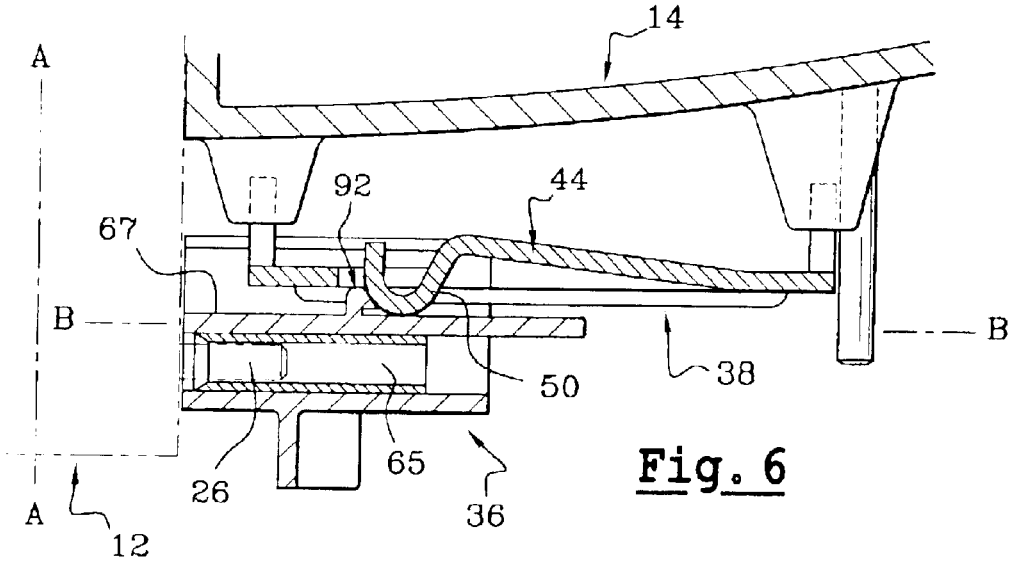
FIG. 6 is a view similar to the preceding one which represents the terminal block in locked position.
Figure 9:
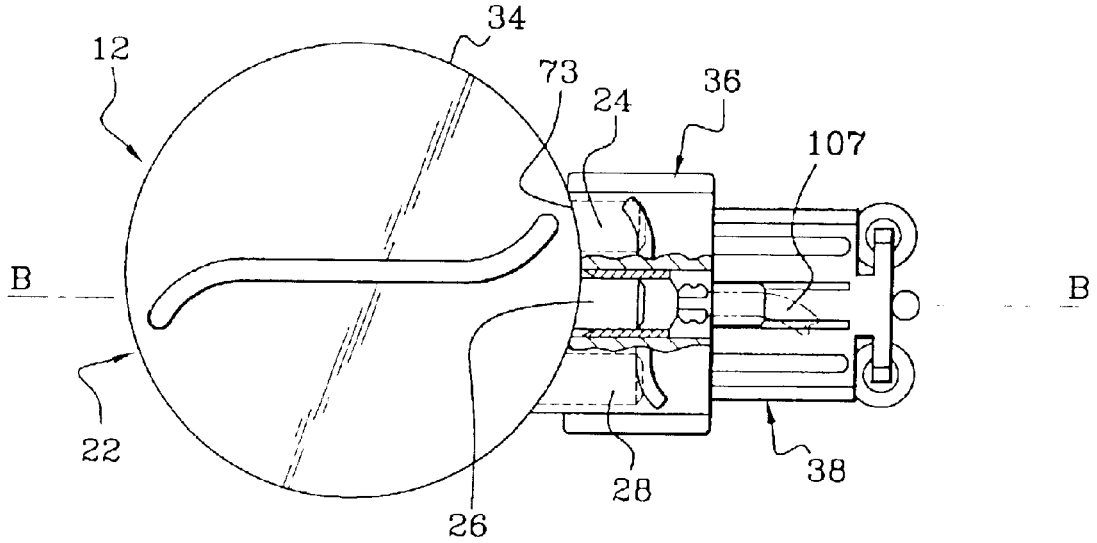
FIG. 9 is a view similar to that of FIG. 7 which represents the lamp in fitted and connected position, the terminal block occupying its locked position.

In FIGS. 6 and 9, the terminal block 36 is represented in locked position, or connection position, that is to say that it occupies an extreme position on the left along the transverse connecting direction B—B.

The terminal block 36 is formed mainly of a substantially rectangular housing 66 parallel to a transverse plane.

The housing 66, in its axial thickness, delimits three ducts, or housings 68, 70, 72, which are substantially rectangular and which extend parallel along the transverse direction B—B and which are contained in the same transverse plane.

The housings 68, 70, 72 are open at each of their transverse extremities and they are designed so as each to accommodate a connecting terminal, here in the form of a connecting socket 65

Each of the transverse faces 67, 69 of the housing 66 includes, face-to-face with the lamp 12, an extreme transverse edge 71, 73 which here has a circular-arc profile complementary to the axial surface 34 opposite the lamp base 22 of the lamp 12.

In the locked position of the terminal block 36, as represented in FIGS. 6 and 9, the extreme transverse edges 71, 73 in a circular arc are substantially adjacent to the axial surface 34 of the lamp base 22.

This circular-arc profile especially has an indexing function and ensures the correct positioning of the terminal block 36 on the slideway 38.

The terminal block 36 also includes two wings 74, 76 which extend substantially horizontally forwards from each rear transverse edge 78, 80 of the housing 66.

As can be seen in FIG. 4, the extreme front transverse edge 82, 84 of each wing 74, 76 is curved over towards the opposite edge 82, 84, so as to form a rim which delimits a transverse surface 86, 88 oriented rearwards. These rear transverse surfaces 86, 88 are designed to come into axial abutment rearwards against the front face 90 of the slideway 38, when the terminal block 36 is fitted on the slideway 38.

Advantageously, the front transverse face 94 of the housing 66 carries a pin 92 which is designed to co-operate with the boss 50 of the elastic tab 44 with a view to indexing the terminal block 36 in its locked position.

The pin 92 has its extreme axial edge 96 rounded, and it delimits a ramp 98, on the right-hand side when considering FIG. 5, with a view to facilitating its sliding rightwards against the boss 50 of the tab 44.

The front face 67 of the housing 66 also includes two elastic strips 99, 101 which here extend transversely (B—B) over the major part of the transverse length of the housing 66, on either side of the pin 92.

Each of the strips 99, 101 extends overall forwards and is curved over when going away from the pin, that is to say respectively upwards and downwards when considering FIG. 4.

Each of the strips 99, 101 thus delimits a substantially transverse surface 103, 105 which is designed to be in axial abutment forwards against the associated rails 40, 42 facing the slideway 38.

In the fitted position of the terminal block 36 on the slideway 38, the elastic strips 99, 101 are therefore deformed rearwards and they axially spring the terminal block 36 forwards, in such a way that each guide rail 40, 42 is pinched axially between the rim 82, 84 and the strip 99, 101 which are associated, which holds the terminal block 36 on the slideway 38.

Advantageously, the front face 67 of the housing 66 is extended transversely, rightwards when considering FIG. 5, by a tenon 100 which is designed to come into transverse abutment to the right against an abutment stud 102, when the terminal block 36 occupies its unlocked position, so as to keep it spaced away from the lamp 12.

The abutment stud 102 here extends axially rearwards from the rear face 18 of the reflector 14.

The transverse length (B—B) of the tenon may be defined by design, so as to determine the transverse position of the terminal block 36 on the slideway 38 when it occupies its unlocked position.

The terminal block 36 finally includes a gripping element 104 which has the shape here of a wavy claw extending axially rearwards from the rear transverse face 69 of the housing 66, and which allows a user easily to handle the terminal block 36, in such a way as to make it slide transversely between its locked position, to the left, and its unlocked position, to the right.

The terminal block 36 is preferably produced by moulding from plastic.

The terminal block 36 is designed to accommodate an identical connecting socket 65 in each of its housings 68, 70, 72.

Figure 8:
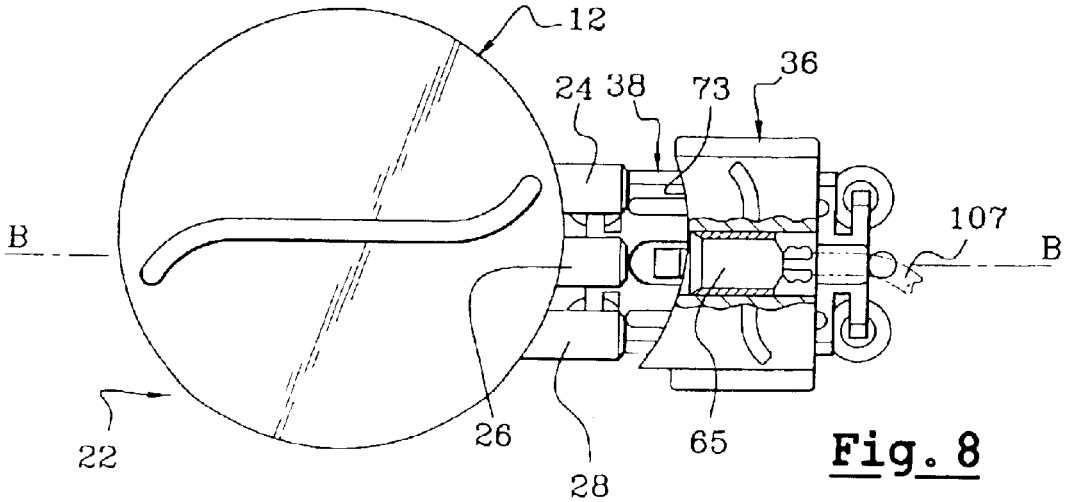
FIG. 8 is a view similar to the preceding one which represents the lamp in fitted position before its connection, the terminal block occupying its unlocked position.

As can be seen in the partially cut away view of FIG. 8, each connecting socket 65 forms an electrical contact which is designed to accommodate, internally, in a complementary manner, an associated contact strip 24, 26, 28 of the lamp 12.

To that end, when the lamp 12 is in fitted position and when the terminal block 36 is fitted on the slideway 38, the sockets 65 are then in the same transverse plane as the contact strips 24, 26, 28, and each socket 65 is then aligned transversely (B—B) with the associated contact strip 24, 26, 28.

The terminal block 36 here includes three sockets 65 associated respectively with the three contact strips 24, 26, 28 of the lamp 12.

Each connecting socket 65 is connected, by its transverse extremity opposite the lamp 12, to an electrical wire 107.

The electrical wires 107 belong to an electrical power-supply harness (not represented) of the vehicle.

This may take the form of an electrical harness internal to the housing of the headlamp, which is assembled together with other electrical harnesses which are necessary for the operation of the headlamp as a whole (which may include a number of lamps); the electrical harness is then generally assembled to the other harnesses via a common connector, leaving the housing through an ad hoc orifice.

According to another variant, the electrical harness leaves the housing via an ad hoc orifice, either directly or through a connector which is specific to it.

Advantageously, the sockets 65 are of standard type, such as those which are used in conventional connecting devices, which makes it possible to reduce the costs of manufacture while ensuring the reliability of the connections.

The operations of fitting and of connecting the lamp 12 will now be explained, in the context of the arrangement 10 according to the invention.

Prior to the fitting of the lamp 12, it is necessary to put in place the elements of the arrangement 10 according to the invention on the reflector 14.

It is therefore necessary for the terminal block 36 to be fitted sliding on the slideway 38. To do that, the terminal block 36 is displaced transversely towards a transverse extremity (B—B) of the slideway 38 in such a way that the rear transverse surface 86, 88 of each turned-up edge 82, 84 of the terminal block 36 slides on the front transverse surface 90 of the slideway 38, and in such a way that the elastic strips 99, 101 come into axial abutment against the associated guide rails 40, 42.

It is necessary for the slideway 38 equipped with the terminal block 36 to be fitted on the rear face 18 of the reflector 14. To do that, the front axial extremity 60 of each claw 58 is inserted into the hole 62 of the associated stud 64.

Finally, it is necessary for the sockets 65 to be fitted into the terminal block 36. To do that, each socket 65 is inserted into its associated housing 68, 70, 72 following a transverse movement from the right to the left when considering FIG. 1.

In order for the fitting of the lamp 12 to be possible, it is necessary furthermore for the terminal block 36 to occupy its unlocked position, for a reason which will be described in what follows.

Figure 2:
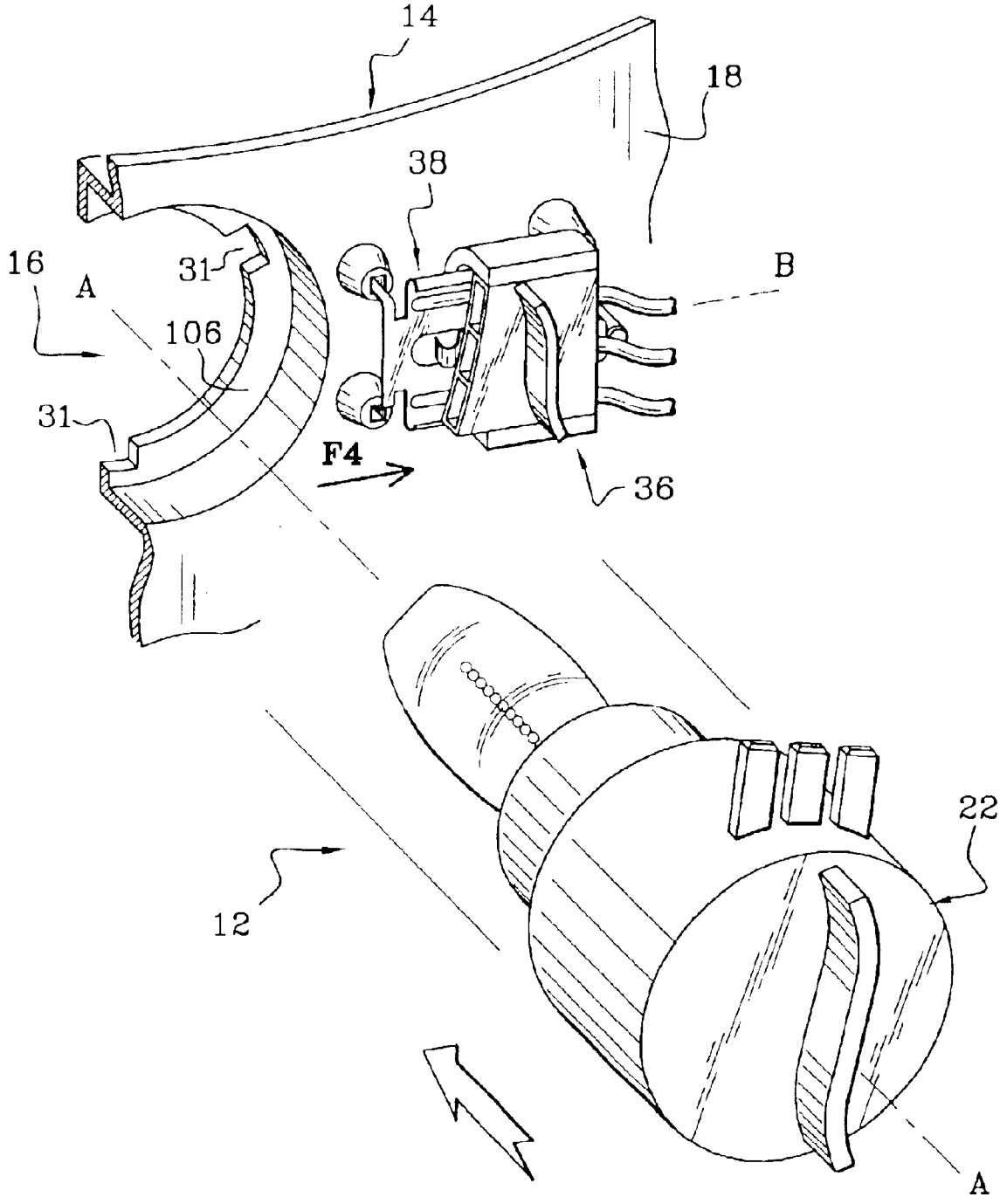
FIG. 2 is a perspective view which diagrammatically represents the arrangement of FIG. 1 before the fitting of the lamp in its support, the terminal block occupying its unlocked position on the slideway.

The position of all the elements of the arrangement 10 before the fitting of the lamp 12 is represented in FIG. 2.

In this figure it is observed that the terminal block 36 is in unlocked position since the boss 50 of the elastic tab 44 is positioned to the left of the housing 66.

As can be seen in FIG. 5, in unlocked position, the terminal block 36 is held transversely to the left since the extreme front transverse edge 71 of the housing 66 is in leftwards transverse abutment against the boss 50. The terminal block 36 is held transversely to the right since the tenon 100 is in rightwards transverse abutment against the abutment stud 102.

The elastic tab 44 thus makes it possible to index the terminal block 36 in its unlocked position.

As the lamp 12 is designed to be fitted in the hole 16 using a fitting of the bayonet type, or "quarter-turn fitting", it is necessary to align it in angle with respect to the notches 31 before it is inserted into the hole 16. This is what has been represented in FIG. 2, where the contact strips 24, 26, 28 of the lamp 12 are not oriented along the transverse direction B—B, as they will be in fitted position, but they are offset in angle upwards.

The fitting of the lamp 12 into the hole 16 therefore comprises two stages.

Figure 7:
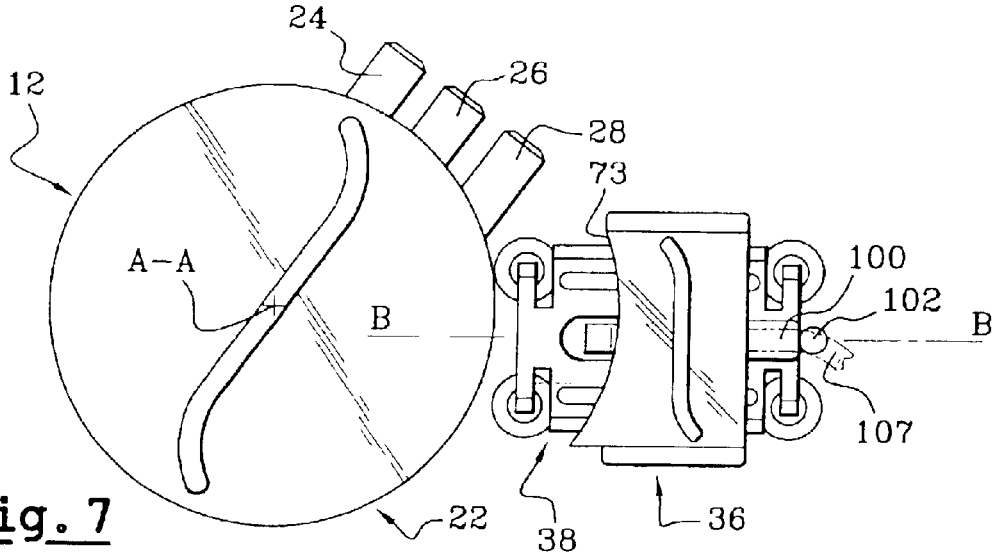
FIG. 7 is a rear view which diagrammatically represents the lamp when it is inserted into the hole of the support, before its pivoting towards its final connection position, the terminal block occupying its unlocked position.

In the course of a first stage, the lamp 12 is inserted into the hole 16 of the reflector 14 following a forwards axial movement. The lamp 12 is then in the position which is represented in FIG. 7, where the lamp base 22 is in axial abutment towards the front against a face-to-face transverse surface 106 of the reflector 14, and where the contact strips 24, 26, 28 are offset in angle (about the axis A—A) with respect to the transverse connecting direction B—B.

Figure 3:
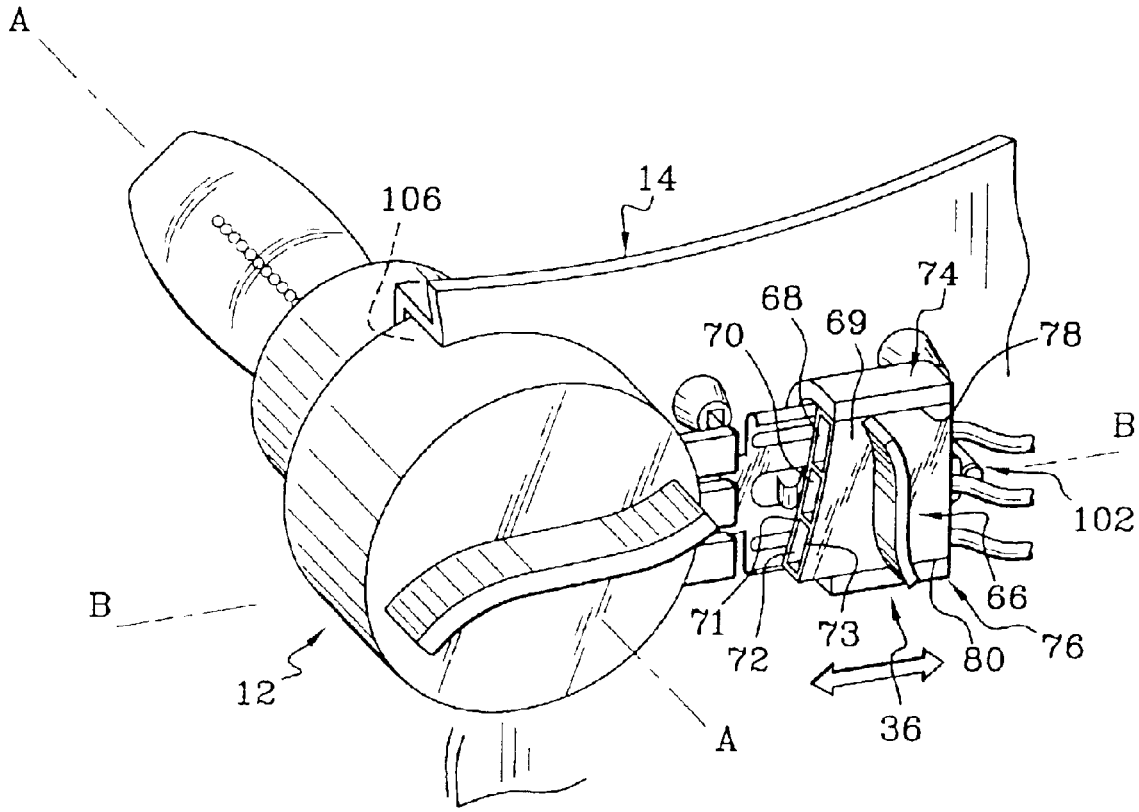
FIG. 3 is a view similar to the preceding one which represents the arrangement of FIG. 1 when the lamp is fitted in its support and before its electrical connection, the terminal block occupying its unlocked position on the slideway.

In the course of a second stage, the lamp 12 is made to pivot about its axis A—A, here in the clockwise direction, until it is secured in the hole 16. This final position of the lamp 12, before it is connected, is represented in FIGS. 3 and 8.

In this axial and angular position, the contact strips 24, 26, 28 are parallel to the transverse connecting axis B—B and they are aligned transversely with the sockets 65 associated with the terminal block 36.

The lamp 12 is then connected in the following way.

The terminal block 36 is shifted towards the lamp 12, along the transverse connecting axis B—B, by making it slide on the slideway 38.

In the first place, the boss 50 of the elastic tab 44 forms a ramp which interacts with the extreme front transverse edge 71 of the housing 66, in such a way that the elastic tab 44 is retracted forwards, being deformed elastically.

The terminal block 36 then continues to slide towards the lamp 12, whereas, simultaneously, the boss 50 is in abutment to the rear and it slides against the front face 67 of the housing 66.

While the terminal block 36 is sliding, the contact strips 24, 26, 28 penetrate progressively into the associated sockets 65.

In the second place, in the course of the sliding, the pin 92 encounters the boss 50 and it causes a further deformation of the tab 44, until it protrudes transversely leftwards past the boss 50, which, for the user, causes a sensation of passing over a notch.

The terminal block 36 then occupies its locked position, which is represented in FIG. 6, in which the connection with the lamp 12 is formed.

In this locked position, the contact strips 24, 26, 28 here are inserted fully inside the sockets 65, and they form, in pairs, an electrical connection by contact.

The pin 92 is in substantially transverse abutment to the right against the boss 50 of the tab 44, such that the terminal block 36 is held transversely against the lamp base 22 of the lamp 12, hence in its locked position, and in such a way that only a transverse force rightwards exerted by the user can cause the terminal block 36 to come out of its locked position.

In order to disconnect and remove the lamp 12, it is sufficient to repeat, in the reverse direction, the operations which have just been described, that is to say that it is necessary to make the terminal block 36 slide transversely from the left to the right, from its locked position into its unlocked position, then it is necessary to cause the lamp 12 to pivot about its axis A—A, here in the anti-clockwise direction, until it is detached from the reflector 14, then it is necessary to withdraw the lamp 12 from the hole 16, displacing it axially rearwards.

It will be noted that, if the terminal block 36 is placed in its locked position before the lamp 12 is fitted into the reflector 14, it is impossible to fit the lamp 12. This is because the terminal block 36 is then located in the area of free movement of the contact strips 24, 26, 28, that is to say that it prevents the final pivoting of the lamp 12 about its axis A—A, which should make it possible to align the contact strips 24, 26, 28 with the transverse connecting axis B—B.

In contrast, when the lamp 12 is in fitted position and when the terminal block 36 occupies its locked position, then the terminal strip 36 immobilises the lamp 12 in its fitted position. The removal of the lamp 12 then requires it to be disconnected beforehand by unlocking of the terminal block 36.

The arrangement 10 according to the invention thus affords a significant improvement in terms of security and reliability of the fitting and of the connecting of the lamp 12.

Moreover, thanks to the arrangement 10 according to the invention, it is possible, at the design stage, to determine the length of the electrical wires 107 which is necessary and sufficient to allow the lamp 12 to be connected, since the type of movement performed by the terminal block 36 during the connecting operations is known precisely.

According to a variant (not represented) of this embodiment, the slideway 38 can be designed in such a way as to make it function as a negative terminal. It is then linked electrically to the main connector (not represented) of the headlamp.

Upon locking of the terminal block 36, the negative contact strip of the lamp 12 is designed to come into contact with the slideway 38 so as to provide an electrical link.

Figure 10:
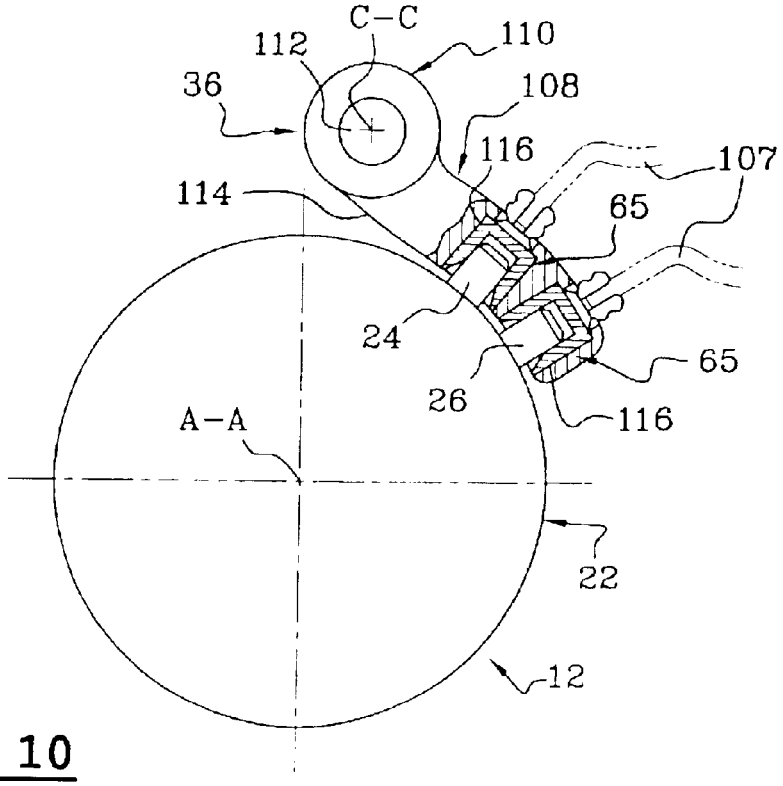
FIG. 10 is a rear view which diagrammatically represents a second embodiment of the invention in which the axis of pivoting of the terminal block is parallel to the axis of the lamp.

According to a second embodiment of the invention, which is represented in FIG. 10, the terminal block 36 can be mounted so as to pivot about an axis C—C which is substantially parallel to the axis A—A of the lamp 12.

According to the embodiment which is represented here, the terminal block 36 includes an arm 108 which extends in a substantially transverse plane from a substantially cylindrical segment 110 with axis C—C.

The cylindrical segment 110 is mounted so as to pivot on a stud 112 which can be carried by the rear face 18 of the reflector 14.

The arm 108 includes an axial surface 114 substantially parallel to the axial surface 34 of the base 22 of the lamp 12, when the terminal block 36 occupies its connecting position which is represented in FIG. 10.

The terminal block 36 here includes two housings 116 each containing a socket 65 associated with a contact strip 24, 26.

The contact strips 24, 26 and the sockets 65 belong to the same transverse plane.

Advantageously, the sockets 65 and the associated contact strips 24, 26 are oriented substantially radially with respect to the axis A—A of the lamp 12.

According to this embodiment, the lamp 12 is connected in the following way.

After the lamp 12 has been fitted into the hole 16 of the reflector 14, the terminal block 36 is made to pivot about its axis C—C in the clockwise direction, towards the lamp 12, from a position in which the arm 108 is spaced away from the lamp 12, until the contact strips 24, 26 penetrate into the associated sockets 65.

Disconnection is carried out by performing these operations in the reverse order.

Needless to say, the two embodiments described above can be combined.

It is possible, for example, to use a terminal block 36 which is mounted sliding transversely with a lamp 12 including contact strips 24, 26 which are oriented radially with respect to the axis A—A of the lamp 12.

It is also possible to use a terminal block 36 which is mounted pivoting about an axis C—C parallel to the axis A—A of the lamp 12 with a lamp 12 including contact strips 24, 26, 28 substantially parallel to a transverse axis B—B.

Figure 11:
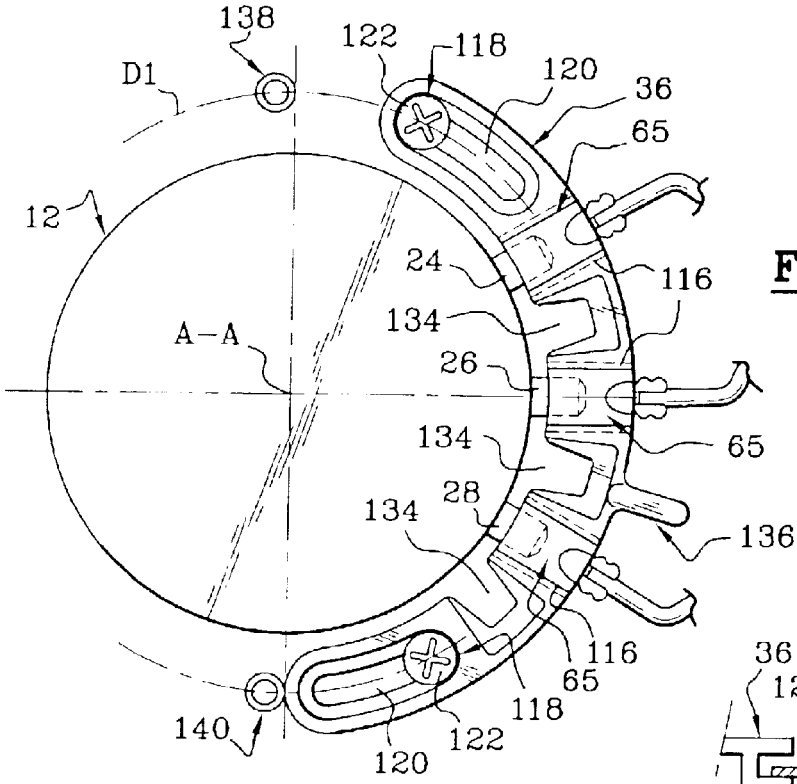
FIG. 11 is a rear view which diagrammatically represents a third embodiment of the invention in which the axis of pivoting of the terminal block is coaxial with the axis of the lamp, the terminal block occupying its locked position.
Figure 13:
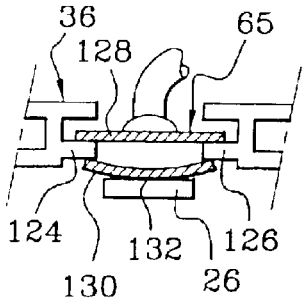
FIG. 13 is a sectional view of a detail of FIG. 11 which represents a connecting terminal in contact with a contact strip of the lamp.
Figure 12:
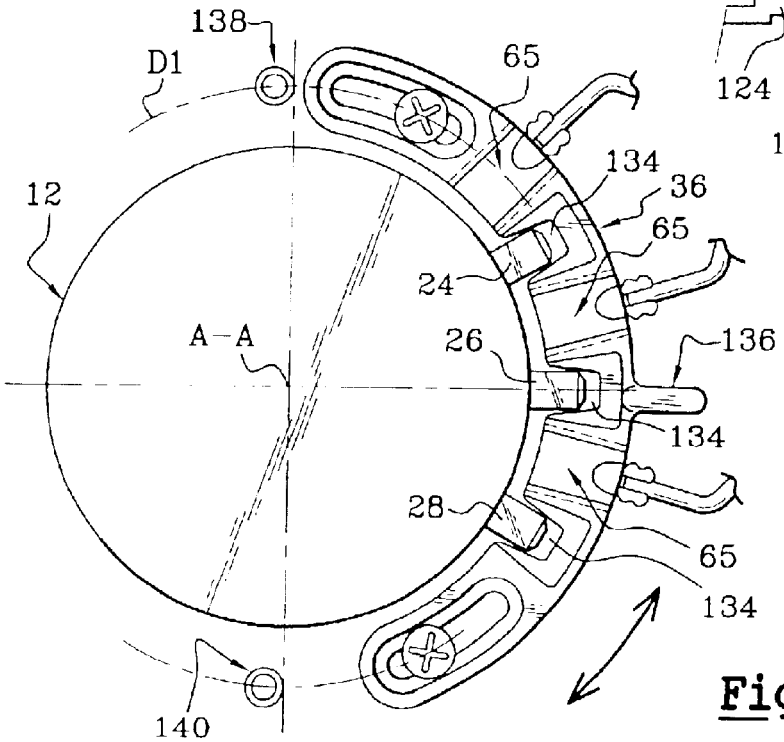
FIG. 12 is a view similar to that of FIG. 11 which represents the terminal block in its unlocked position.

A third embodiment of the invention has been represented in FIGS. 11 to 13, in which the terminal block 36 is mounted sliding in a transverse plane along a circumferential direction D1 coaxial with the axis A—A of the lamp 12.

In FIG. 11, the terminal block 36 has been represented in locked position in which the connecting of the lamp 12 has been carried out.

In FIG. 12, the terminal block 36 is represented in unlocked position, the lamp 12 then being disconnected.

With a view to allowing it to slide circumferentially, the terminal block 36 is mounted on the rear face 18 of the reflector 14 by means of two screws 118, each passing axially through a guide slot 120 formed at one circumferential extremity of the terminal block 36.

Each guide slot 120 has the shape of an oblong hole which extends along the circumferential direction D1. Each guide slot 120 has a radial profile which is substantially complementary with the profile of the head 122 of the associated screw 118, such that the guide slots 120 interact with the associated screw 118 with a view to guiding the terminal block 36 as it slides along the circumferential direction D1.

According to this embodiment, the lamp 12 includes contact strips 24, 26, 28 which are oriented radially with respect to the axis A—A of the lamp 12.

The terminal block 36 has the general shape of a banana, and it extends along the circumferential direction D1.

Here it includes three housings 116 which are each intended to receive a connecting terminal 65 along a substantially radial direction.

As has been represented in FIG. 13, the shape of the housings 116 is designed to allow the connecting terminals 65 to be pushed in. To that end, each housing 116 here includes two radial and transverse ribs 124, 126 which are arranged on either side of the connecting terminal 65.

Each connecting terminal 65 here includes two transverse metal plates 128, 130 which are superimposed axially and which come into axial abutment respectively on the rear face and on the front face of the associated ribs 124, 126, so as to retain the connecting terminal 65 in the housing 116.

The front metal plate 130 of each connecting terminal 65 here delimits a boss 132 which is convex forwards, which is designed to form the electrical contact with the rear face of the associated contact strip 24, 26, 28, when the terminal block 36 occupies its locked position.

The terminal block 36 also includes, in its axial wall facing the lamp 12, three cut-outs 134 which are offset in angle, here in the clockwise direction, with respect to the three associated housings 116.

These cut-outs 134 are designed to be aligned radially with the associated contact strips 24, 26, 28 of the lamp 12, when the terminal block 36 occupies its unlocked position, with a view to allowing the removal of the lamp 12, as will be explained in what follows.

The dimensions of each cut-out 134 in the transverse plane should allow the associated contact strip 24, 26, 28 to pass when the lamp 12 is fitted or removed axially, respectively forwards and rearwards, the terminal block 36 occupying its unlocked position, as can be seen in FIG. 12.

The terminal block 36 includes another gripping element 136, which here takes the general form of an axial plate extending radially outwards, from the outer axial face of the terminal block 36.

The gripping element 136 allows the user to handle the terminal block 36 in such a way as to make it slide along the circumferential direction D1, from its locked position to its unlocked position.

Advantageously, the reflector 14 includes two axial studs 138, 140 each forming a circumferential abutment counter to the facing circumferential extremity of the terminal block 36, when it occupies its locked position and its unlocked position respectively.

According to this third embodiment, the lamp 12 is connected in the following way.

The terminal block 36 is placed in its unlocked position, as represented in FIG. 12, that is to say that it is made to slide along the circumferential direction D1 in the anti-clockwise direction as far as the associated abutment stud 138.

The lamp 12 is fitted axially into the hole 16 of the reflector 14, by aligning the contact strips 24, 26, 28 axially with the associated cut-outs 134 such that the contact strips 24, 26, 28 can pass axially through the cut-outs 134 during this fitting phase.

When the lamp 12 has been fitted, the contact strips 24, 26, 28 extend in a radial plane situated forwards of the radial plane in which the connecting terminals 65 extend.

When the terminal block 36 is made to slide along the circumferential direction D1 in the clockwise direction up to the associated abutment stud 140, in accordance with the representations of FIGS. 11 and 12, the connecting terminals 65 align radially with the contact strips 24, 26, 28 such that each boss 132 comes into contact with the rear face of the associated contact strip 24, 26, 28.

Disconnection is carried out by performing these operations in the reverse order.

A fourth embodiment will now be described, by reference to FIGS. 14 to 16, in which the terminal block 36 is mounted pivoting about a substantially transverse axis E—E.

As in the second and third embodiments, the contact strips 24, 26, 28 here are oriented substantially radially with respect to the axis A—A of the lamp 12.

Figure 14:
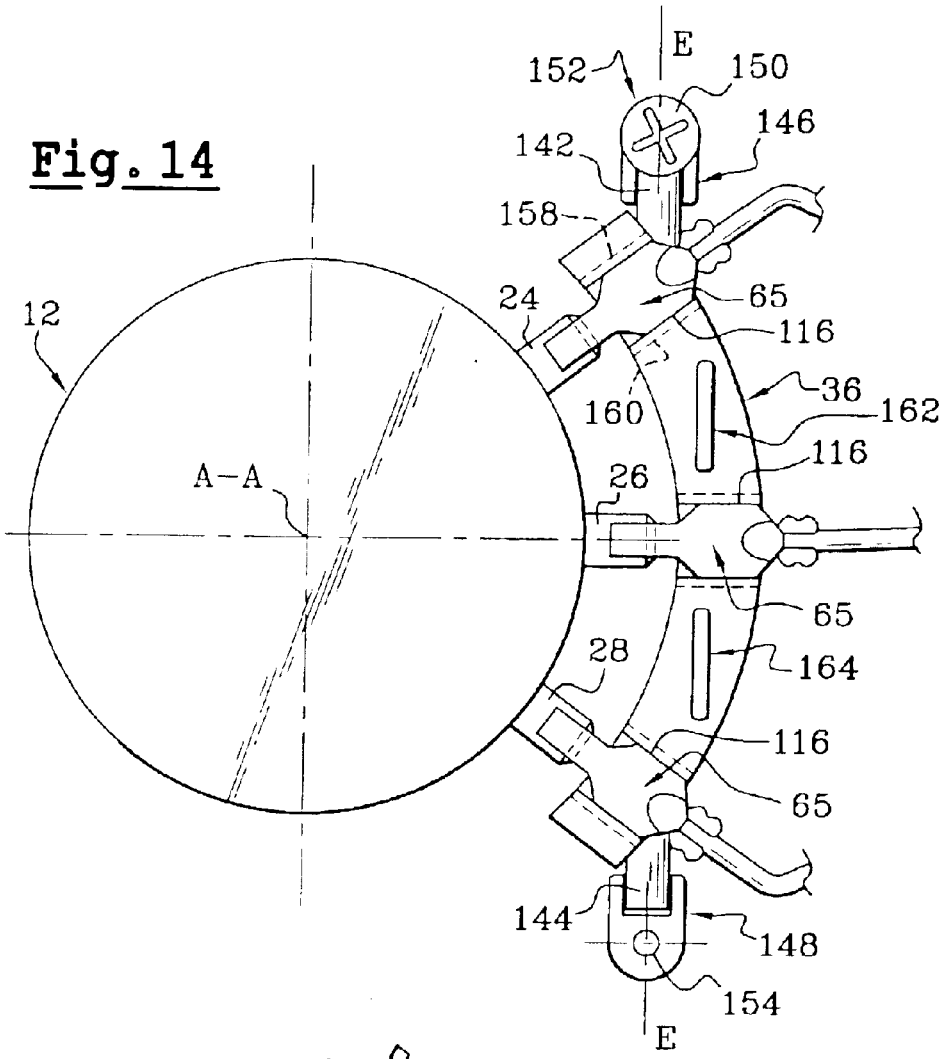
FIG. 14 is a rear view which diagrammatically represents a fourth embodiment of the invention in which the axis of pivoting of the terminal block is transverse to the axis of the lamp, the terminal block occupying its locked position.

Considering FIG. 14, in which the terminal block 36 is represented in locked position, here the block has the shape of a transverse plate in a circular arc with axis A—A which, in its outer axial face, in the vicinity of each of its circumferential extremities, includes a journal 142, 144 with transverse axis E—E which forms a pivot for the terminal block 36.

Each journal 142, 144 is mounted free to rotate in a complementary bearing 146, 148 carried by the rear face 18 of the reflector 14.

Each bearing 146, 148 here has the shape of a channel open to the rear so as to allow the fitting of the associated journal 142, 144 axially (A—A) from back to front. Each journal 142, 144 is held in the associated bearing 146, 148 by the head 150 of a screw 152, the screw 152 being fitted into an axial hole 154 (A—A) formed in a portion of the associated bearing 146, 148.

The terminal block 36 includes housings 116 which are designed for the fitting of the connecting terminals 65.

Figure 15:
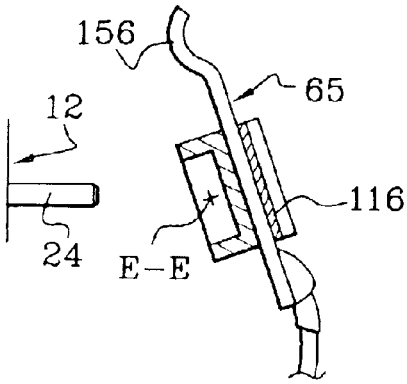
FIG. 15 is a sectional view which represents the terminal block of FIG. 14 in unlocked position.
Figure 16:
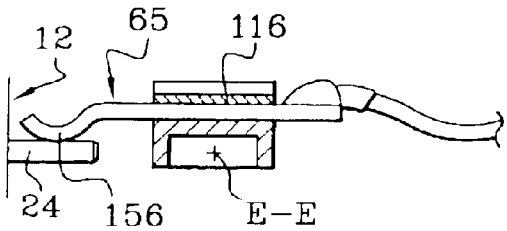
FIG. 16 is a view similar to that of FIG. 15 which represents the terminal block in locked position.

As can be seen especially in FIGS. 15 and 16, each connecting terminal 65 here has the shape of a strip including, at its free extremity, at the lamp end, a boss 156 which is convex towards the front and which is designed to come into contact with the rear face of an associated contact strip 24, 26, 28.

Each housing 116 here includes two radial and transverse grooves 158, 160 in which the radial edges of the associated connecting terminal 65 are inserted.

The terminal block 36 here includes two gripping plates 162, 164 which extend parallel to the transverse axis E—E and which extend axially (A—A) rearwards when considering FIG. 14, with a view to facilitating the handling of the terminal block 36 by the user.

The terminal block 36 is represented in FIGS. 14 and 16 in locked position, that is to say that the connecting terminals 65 are in electrical contact with the associated contact terminals 24, 26, 28 of the lamp 12.

In order to pass to unlocked position, the terminal block 36 is made to pivot about its transverse axis E—E, in the clockwise direction when considering FIGS. 15 and 16, such that the connecting terminals 65 move away from the contact terminals 24, 26, 28 of the lamp 12. The terminal block 36 than occupies the position which is represented in FIG. 15.

When the terminal block 36 occupies its unlocked position, it is possible to withdraw the lamp 12, or fit it, by displacing it axially rearwards, or forwards, respectively.

In order to form the electrical connection of the lamp 12, when it is fitted into the reflector, it is sufficient to make the terminal block 36 pivot in the anti-clockwise direction when considering FIGS. 15 and 16, from its unlocked position to its locked position.

Needless to say, a system (not represented) for locking the terminal block 36 in its locked position and in its unlocked position is advantageously provided.

The invention has thus developed an electrical-connection system in which the terminal block is fitted with respect to a support, typically the rear wall of the reflector of the headlamp. There is thus no imprecise, floating fitting. On the contrary, it is possible to make a connection "blind" between the terminal block and the terminals of the lamp, without having to "imagine" the terminals of the lamp during the fitting. Furthermore, the assembly is sure to be locked correctly, since the electrical contact can be made only if the connector (the terminal block) is correctly positioned.

What is claimed is:

1. An arrangement for the electrical connection of a lamp, especially in a motor-vehicle headlamp, the lamp includes a light-source element at the front and axially disposed at a rear, a lamp base equipped with fixed terminals, the lamp is fitted through a support by way of a hole there through and rotated to lock the lamp to the support so that the light-source element of the lamp is disposed on one side of the support and the fixed terminals are disposed on an opposite side of the support, the fixed terminals of the lamp are connected electrically to an electrical power-supply harness by having the fixed terminals put in physical contact with associated connecting terminals carried by the terminal block, wherein the fixed terminals extend laterally overall from a portion of a surface of the lamp base outwards along directions contained in a substantially transverse plane, and in wherein the terminal block is movably fitted to a terminal block engaging means for allowing movement of the terminal block between a locked position on the terminal block engaging means in which, the connecting terminals of the terminal block are in direct, physical, and electrical contact with the fixed terminals, and an unlocked position on the terminal block engaging means in which, the connecting terminals are spaced away from the fixed terminals, in such way that movement of the terminal block to the locked position, or the unlocked position, causes connection, or disconnection, respectively, of the lamp with the electrical power-supply harness.

2. The arrangement according to claim 1, wherein the terminal block is movably fitted to said terminal block engaging means, with respect to the support, in a substantially transverse connecting plane.

3. The arrangement according to claim 1, wherein the fixed terminals are substantially parallel to a transverse connecting direction, and wherein the terminal block is fitted so as to slide along the transverse connecting direction.

4. The arrangement according to claim 1, wherein the terminal block is fitted to said terminal block engaging means to slide on slideway.

5. The arrangement according to claim 2, wherein the terminal block is fitted to said terminal block engaging means to pivot about an axis substatially parallel to an axis of the lamp.

6. The arrangement according to claim 1, wherein the terminal block includes an arm which extends generally in a transverse connecting plane and is fitted to said terminal block engaging means to pivot about and axis by a free extremity, so that the connection, or the disconnection, of the lamp takes place via pivoting of the terminal block towards the lamp, or away from the lamp, respectively.

7. The arrangement according to claim 5, wherein the axis of pivoting of the terminal block is substantially coaxial with the axis of the lamp.

8. The arrangement according to claim 1, wherein the terminal block an axial face opposite the lamp, includes axial clearance aperture associated with each fixed terminal of the lamp and offset an angle with respect to a corresponding connecting terminal in such a way that in the unlocked position, clearance apertures in the terminal block are substantially aligned radially with associated fixed terminals, so as to allow withdrawal of the lamp axially rearwards.

9. The arrangement according to claim 7, wherein the terminal block pivots about the axis of the lamp, sliding along in a circumferential direction, and wherein the terminal block includes at least one guide slot of circumferential orientation which interacts with two axial guide studs fixed to the support and passing through at least one guide slot, for guiding the terminal block in sliding along the circumferential direction.

10. The arrangement according to claim 1, wherein the terminal block is fitted to said terminal block engaging means to pivot about a substantially transverse axis and wherein in the locked position, each connecting terminal is in contact with a rear face of an associated fixed terminal, in such a way that, in order to pass from the locked position to the unlocked position, the terminal block pivots rearward, and, in order to pass from the unlocked position to the locked position, the terminal block pivots forward.

11. The arrangement according to claim 5, wherein the fixed terminals are oriented along directions which are substantially radial with respect to the axis of the lamp.

12. The arrangement according to claim 1, wherein the lamp is fitted to said terminal block engaging means to pivot about an axis of a corresponding hole of the support, and wherein the terminal block is placed in the locked position after a fitting of the lamp in such a way that, in the locked position, the lamp is immobilized in a fitted position in such a way that, if the terminal block occupies the locked position before the fitting of the lamp, the terminal block renders the fitting of the lamp impossible.

13. The arrangement according to claim 1, including means for indexing the terminal block in the unlocked position.

14. The arrangement according to claim 1, including at least one abutment element which limits displacement of the terminal block in a direction of the locked position and/or of the unlocking position.

15. The arrangement according to claim 1, wherein the fixed terminals are contact strips substantially parallel to the transverse plane.

16. The arrangement according to claim 1, wherein the terminal block includes a gripping element for a user to shift the terminal block from the locked position to the unlocked position, and conversely.

17. The arrangement according to claim 1, wherein the terminal block is movably fitted to said terminal block engaging means with respect to the support or with respect to a means fixed to the said support.

18. The arrangement according to claim 1, wherein said terminal block engaging means is coupled to said support.

19. An arrangement for electrical connection of a lamp to an electrical power harness, the lamp having a light source element axially spaced from a lamp base along a lamp axis, the lamp base having electrical connectors extending therefrom in a plane substantially transverse to the lamp axis, the arrangement comprising:

a lamp support having a hole for receiving the lamp there through, the lamp being locked in said hole of said support by rotation of the lamp around the lamp axis, the light source element of the lamp is disposed on one side of the support and the lamp base being disposed on an opposite side of said lamp support;

a terminal block engaging means coupled to said lamp support; and a terminal block slidably engaging said terminal block engaging means for movement of said terminal block along said terminal block engaging means between a first position on said terminal block engaging means in which said terminal block also directly and physically contacts electrical connectors of the lamp, thereby connecting the lamp to an electrical power harness, and a second position on said terminal block engaging means in which said terminal block disengages direct and physical contact with the electrical connectors of the lamp, thereby disconnecting the lamp from the electrical harness, said terminal block slidably engages the terminal block engaging means when in both the first position an the second position.

* * * * *